US008104197B2

(12) United States Patent
Flannery et al.

(10) Patent No.: US 8,104,197 B2
(45) Date of Patent: Jan. 31, 2012

(54) ARTICLE OF FOOTWEAR WITH VERTICAL GROOVES

(75) Inventors: William J. Flannery, Beaverton, OR (US); Andre Kriwet, Portland, OR (US)

(73) Assignee: Nike, Inc., Beaverton, OR (US)

( * ) Notice: Subject to any disclaimer, the term of this patent is extended or adjusted under 35 U.S.C. 154(b) by 29 days.

(21) Appl. No.: 12/613,280

(22) Filed: Nov. 5, 2009

(65) Prior Publication Data

US 2010/0269376 A1 Oct. 28, 2010

Related U.S. Application Data

(63) Continuation of application No. 12/430,561, filed on Apr. 27, 2009, now abandoned.

(51) Int. Cl.
*A43B 13/18* (2006.01)

(52) U.S. Cl. ..... 36/102; 36/30 R; 36/59 C

(58) Field of Classification Search ..... 36/102, 36/30 R, 59 C, 59 R, 25 R, 31
See application file for complete search history.

(56) References Cited

U.S. PATENT DOCUMENTS

| | | | | |
|---|---|---|---|---|
| 4,268,980 | A | 5/1981 | Gudas | |
| 4,550,510 | A * | 11/1985 | Stubblefield | 36/32 R |
| 4,724,624 | A | 2/1988 | Duclos | |
| 4,910,887 | A | 3/1990 | Turner et al. | |
| 5,012,597 | A | 5/1991 | Thomasson | |
| 5,669,162 | A | 9/1997 | Dyer | |
| 5,718,063 | A | 2/1998 | Yamashita et al. | |
| 6,108,943 | A | 8/2000 | Hudson et al. | |
| 6,115,945 | A * | 9/2000 | Ellis, III | 36/102 |
| 6,253,466 | B1 | 7/2001 | Harmon-Weiss et al. | |
| 6,438,870 | B2 | 8/2002 | Nasako et al. | |
| 6,634,121 | B2 * | 10/2003 | Sordi | 36/102 |
| 6,990,755 | B2 | 1/2006 | Hatfield et al. | |
| 7,171,767 | B2 * | 2/2007 | Hatfield et al. | 36/97 |
| 7,234,251 | B2 | 6/2007 | Fuerst et al. | |
| 7,290,357 | B2 | 11/2007 | McDonald et al. | |
| 7,392,604 | B2 | 7/2008 | Greene et al. | |
| 7,392,605 | B2 | 7/2008 | Hatfield et al. | |
| 2002/0004999 | A1 * | 1/2002 | Caine et al. | 36/129 |
| 2004/0148803 | A1 | 8/2004 | Grove et al. | |
| 2005/0076536 | A1 | 4/2005 | Hatfield et al. | |
| 2005/0257405 | A1 | 11/2005 | Kilgore | |
| 2005/0262739 | A1 | 12/2005 | McDonald et al. | |
| 2006/0042120 | A1 | 3/2006 | Sokolowski et al. | |
| 2006/0059721 | A1 | 3/2006 | Hatfield et al. | |
| 2006/0061012 | A1 | 3/2006 | Hatfield et al. | |
| 2006/0213083 | A1 | 9/2006 | Nishiwaki et al. | |

(Continued)

FOREIGN PATENT DOCUMENTS

| | | |
|---|---|---|
| CN | 201182253 | 1/2009 |

(Continued)

OTHER PUBLICATIONS

International Search Report mailed Sep. 20, 2010, from PCT Application No. PCT/US2010/032005.

*Primary Examiner* — Ted Kavanaugh
(74) *Attorney, Agent, or Firm* — Plumsea Law Group, LLC.

(57) ABSTRACT

An article of footwear with a sole that includes a plurality of vertical grooves is disclosed. The plurality of vertical grooves may be disposed on a sidewall and a lower portion of the sole. The vertical grooves can facilitate twisting of the sole.

22 Claims, 10 Drawing Sheets

U.S. PATENT DOCUMENTS

| | | | | |
|---|---|---|---|---|
| 2007/0039205 | A1 | 2/2007 | Erb et al. | |
| 2007/0039208 | A1 | 2/2007 | Bove et al. | |
| 2007/0094896 | A1 | 5/2007 | Hatfield et al. | |
| 2007/0169376 | A1 | 7/2007 | Hatfield et al. | |
| 2007/0169379 | A1 | 7/2007 | Hazenberg et al. | |
| 2007/0199213 | A1 | 8/2007 | Campbell et al. | |
| 2007/0240331 | A1 | 10/2007 | Borel | |
| 2008/0022553 | A1 | 1/2008 | McDonald et al. | |
| 2008/0229617 | A1 * | 9/2008 | Johnson et al. | 36/102 |

FOREIGN PATENT DOCUMENTS

| | | | |
|---|---|---|---|
| EP | 1787540 | | 5/2007 |
| EP | 1832191 | | 9/2007 |
| EP | 1844673 | | 10/2007 |
| JP | 2000197503 | | 7/2000 |
| WO | WO 9105491 | A1 * | 5/1991 |
| WO | WO 96/18317 | | 6/1996 |

* cited by examiner

ARTICLE OF FOOTWEAR WITH VERTICAL GROOVES

CROSS REFERENCE TO RELATED APPLICATION

This application is a Continuation of U.S. application Ser. No. 12/430,561, entitled "Article of Footwear with Vertical Grooves", filed on Apr. 27, 2009, now abandoned which is incorporated herein by reference in its entirety.

BACKGROUND

The present invention relates to an article of footwear, and in particular to a sole of the article of footwear with vertical grooves.

Articles of footwear with grooves have been previously proposed. Hudson (U.S. Pat. No. 6,108,943) teaches an article of footwear with a sole that includes a medial outsole element with a plurality of flex grooves. The grooves are oriented to mimic the direction of many movements made in tennis. Hudson teaches that traction strips can be molded into some or all of the flex grooves. Hudson fails to teach provisions for providing torsion in an article. There is a need in the art for a design that overcomes these shortcomings.

SUMMARY

An article of footwear with a sole that includes a plurality of vertical grooves is disclosed. In one aspect, the invention provides an article of footwear, comprising: a sole including a midsole; a heel portion of a sole comprising a first sidewall and a second sidewall; the heel portion further comprising a first laterally extending portion and a second laterally extending portion disposed on the heel portion of the sole; the first laterally extending portion including a first end portion associated with a first sidewall of the heel portion and the first laterally extending portion including a second end portion associated with a second sidewall of the heel portion; the second laterally extending portion including a third end portion associated with the first sidewall and a fourth end portion associated with the second sidewall; the first end portion being integrally formed with the third end portion on the first sidewall; and where the second end portion is substantially spaced from the fourth end portion and wherein the second end portion is configured to move substantially independently of the fourth end portion.

In another aspect, the invention provides an article of footwear, comprising: a sole including a midsole and an outsole, the outsole configured to contact a ground surface; the midsole including a first sidewall and a second sidewall; the second sidewall including a plurality of vertical grooves; and where the plurality of vertical grooves increases the flexibility of the second sidewall over the first sidewall.

In another aspect, the invention provides an article of footwear, comprising: a sole including a midsole and an outsole, the outsole configured to contact a ground surface; the midsole including a first sidewall and a second sidewall; the first sidewall including a plurality of vertical grooves on a heel portion of the midsole; and where the plurality of vertical grooves allow the heel portion of the sole to undergo torsion.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
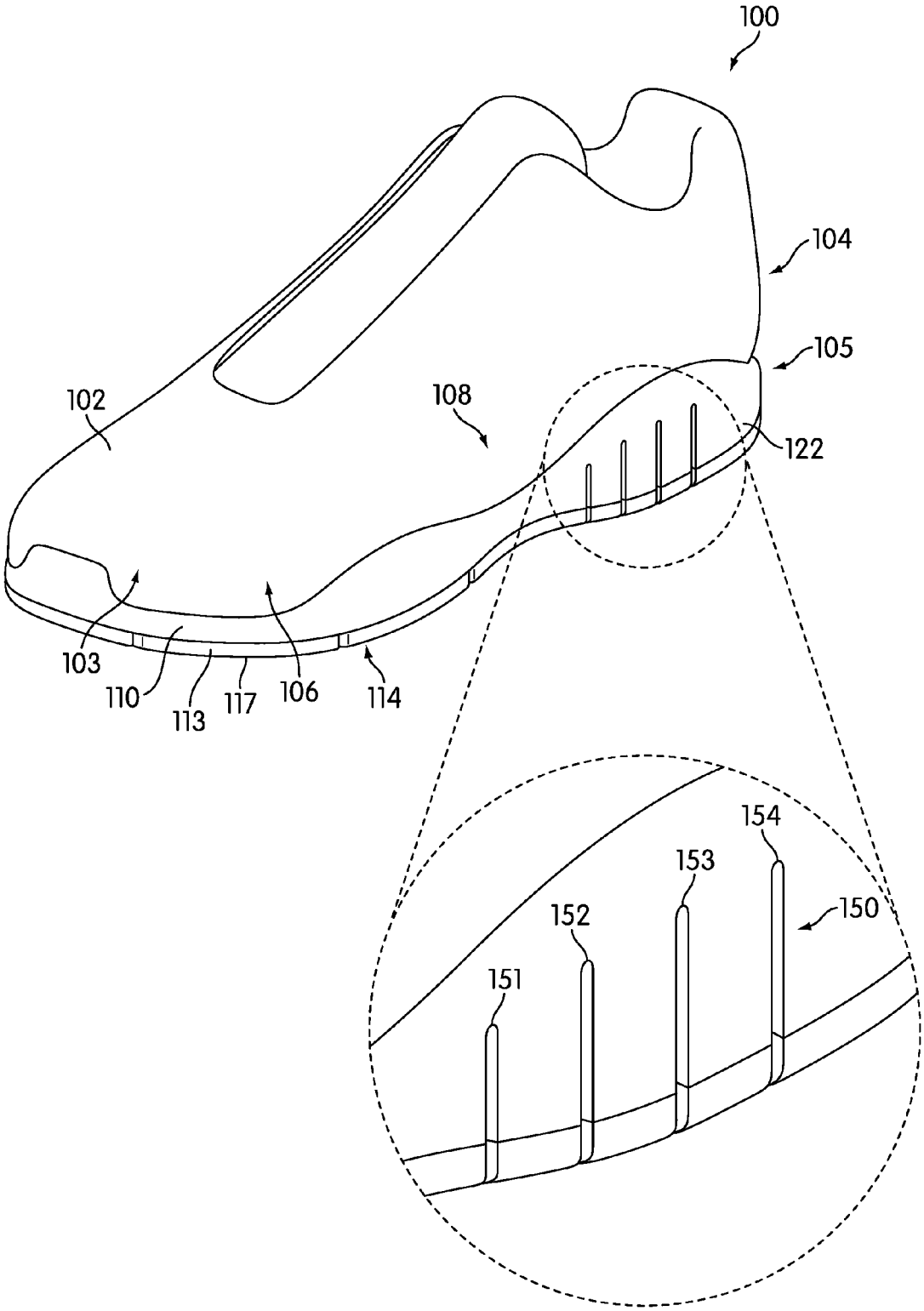
FIG. 1 is an isometric view of an exemplary embodiment of a medial portion of an article of footwear with an enlarged view of a portion of a sole.
Figure 2:
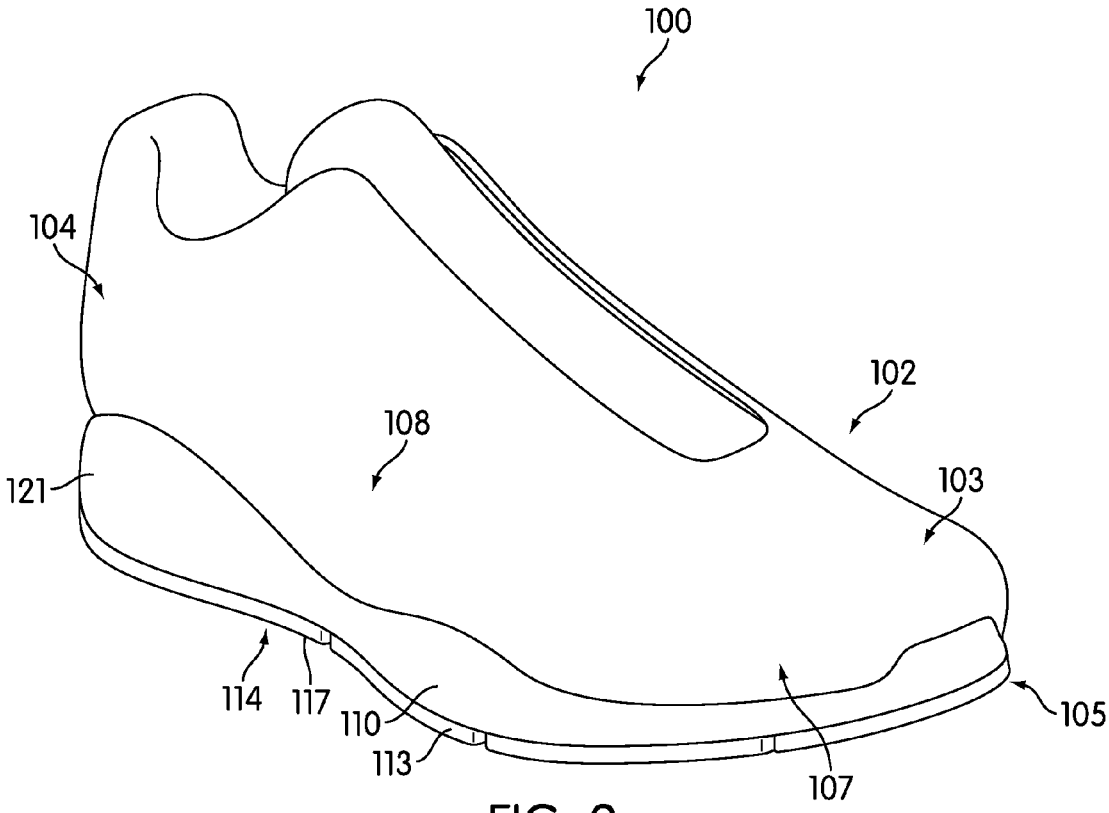
FIG. 2 is an isometric view of an exemplary embodiment of a lateral portion of an article of footwear.

FIGS. 1 and 2 are isometric views of an exemplary embodiment of article of footwear 100. In particular, FIG. 1 is an isometric medial view of an exemplary embodiment of article of footwear 100 and FIG. 2 is an isometric lateral view of an exemplary embodiment of article of footwear 100. For clarity, the following detailed description discusses an exemplary embodiment, in the form of a sports shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIGS. 1 and 2, article of footwear 100, also referred to simply as article 100, is intended to be used with a right foot; however, it should be understood that the following discussion may equally apply to a mirror image of article of footwear 100 that is intended for use with a left foot.

In different embodiments, article 100 can comprise different portions. In an exemplary embodiment, article 100 includes upper 102. Upper 102 is configured to receive a foot of a wearer of article 100. Generally, upper 102 may be any type of upper. In particular, upper 102 could have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

For purposes of reference, article 100 may be divided into forefoot portion 103, midfoot portion 108 and heel portion 104. Forefoot portion 103 may be generally associated with the toes and joints connecting the metatarsals with the phalanges. Midfoot portion 108 may be generally associated with the arch of a foot. Likewise, heel portion 104 may be generally associated with the heel of a foot, including the calcaneus bone. In addition, article 100 may include lateral portion 107 and medial portion 106. In particular, lateral portion 107 and medial portion 106 may be opposing sides of article 100. Furthermore, both lateral portion 107 and medial portion 106 may extend through forefoot portion 103, midfoot portion 108 and heel portion 104.

It will be understood that forefoot portion 103, midfoot portion 108 and heel portion 104 are only intended for purposes of description and are not intended to demarcate precise portions of article 100. Likewise, lateral portion 107 and medial portion 106 are intended to represent generally two sides of article 100, rather than precisely demarcating article 100 into two halves. In addition, forefoot portion 103, midfoot portion 108 and heel portion 104, as well as lateral portion 107 and medial portion 106, can also be applied to individual components of article 100, such as a sole structure and/or upper 102.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of a sole. In other words, the lateral direction may extend between a medial portion and a lateral portion of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

Article 100 may be associated with sole 105. In different embodiments, sole 105 may include different components. For example, sole 105 may include an outsole, a midsole, and/or an insole. In one embodiment, sole 105 includes midsole 110 and outsole 113.

In some embodiments, outsole 113 can be configured to contact a ground surface. In particular, lower portion 114 of outsole 113 may be configured to contact a ground surface. Examples of ground surfaces include, but are not limited to: indoor ground surfaces such as wood and concrete floors, pavement, natural turf, synthetic turf, dirt, as well as other surfaces. In some cases, lower portion 114 may include provisions for traction, including, but not limited to, traction elements, studs and/or cleats. It will be understood that in other embodiments, an outsole may be optional. In other embodiments, for example, a midsole may be configured to contact a ground surface directly. Furthermore, in other embodiments, a midsole could be provided with various traction elements, studs and/or cleats. In still other embodiments, portions of a midsole and portions of an outsole can both be configured to contact a ground surface.

In some embodiments, midsole 110 may comprise one or more sidewalls. The term "sidewall" as used throughout this detailed description and in the claims refers to an outer portion of a midsole that extends from an outsole to an upper. In some cases, midsole 110 can include first sidewall 121 and second sidewall 122, disposed opposite of first sidewall 121. In one embodiment, first sidewall 121 may be associated with lateral portion 107 of sole 105, as illustrated in FIG. 2. Similarly, in one embodiment, second sidewall 122 can be associated with medial portion 106 of sole 105, as illustrated in FIG. 1.

Sole 105 can also include peripheral edge 117. Peripheral edge 117 may be disposed between lower portion 114 and first sidewall 121 as well as between lower portion 114 and second sidewall 122. As peripheral edge 117 circumscribes sole 105, peripheral edge 117 can be disposed adjacent to first sidewall 121 and second sidewall 122.

For clarity, only some portions of article 100 are discussed in this embodiment. It should be understood that article 100 may include other provisions known in the art. For example, article 100 may be associated with various types of fastening systems including, but not limited to laces, straps, zippers, hook and loop fasteners, as well as other types of fastening systems. However, in other embodiments, article 100 may be a slip-on type of article of footwear that does not require lacing.

A sole of an article of footwear can include provisions to increase flexibility of a heel portion. In some embodiments, a sole may be configured to increase the flexibility of a first portion of a sole with respect to a second portion of the sole. In some cases, a plurality of vertical grooves disposed in a first sidewall can increase the flexibility of the first sidewall with respect to a second sidewall. With this arrangement, the plurality of vertical grooves can increase the flexibility of the heel portion.

Referring to FIG. 1, sole 105 includes plurality of vertical grooves 150. Plurality of vertical grooves 150 may be associated with various portions of sole 105, including, but not limited to, forefoot portion 103, midfoot portion 108 and heel portion 104. In an exemplary embodiment, plurality of vertical grooves 150 may be associated with heel portion 104 of sole 105.

In some embodiments, plurality of vertical grooves 150 may be disposed on first sidewall 121 and second sidewall 122 of heel portion 104. In other embodiments, plurality of vertical grooves 150 may be disposed on either first sidewall 121 or second sidewall 122 of heel portion 104. In one embodiment, plurality of vertical grooves 150 may be disposed on second sidewall 122 of heel portion 104. With this configuration, plurality of vertical grooves 150 can increase the flexibility of second sidewall 122 with respect to first sidewall 121.

In different embodiments, plurality of vertical grooves 150 may include various numbers of vertical grooves. In some cases, plurality of vertical grooves 150 can include one vertical groove. In other cases, plurality of vertical grooves 150 can include two or more vertical grooves. Referring to an enlarged view illustrated in FIG. 1, plurality of vertical grooves 150 includes four vertical grooves. In particular, plurality of vertical grooves 150 comprises first vertical groove 151, second vertical groove 152, third vertical groove 153 and fourth vertical groove 154.

In some embodiments, plurality of vertical grooves 150 may be relatively narrow. In particular, vertical grooves of plurality of vertical grooves 150 may have a long narrow shape on second sidewall 122. In other words, the vertical height of plurality of vertical grooves 150 may substantially exceed the distances the vertical grooves extend in a longitudinal direction on second sidewall 122.

Figure 3:
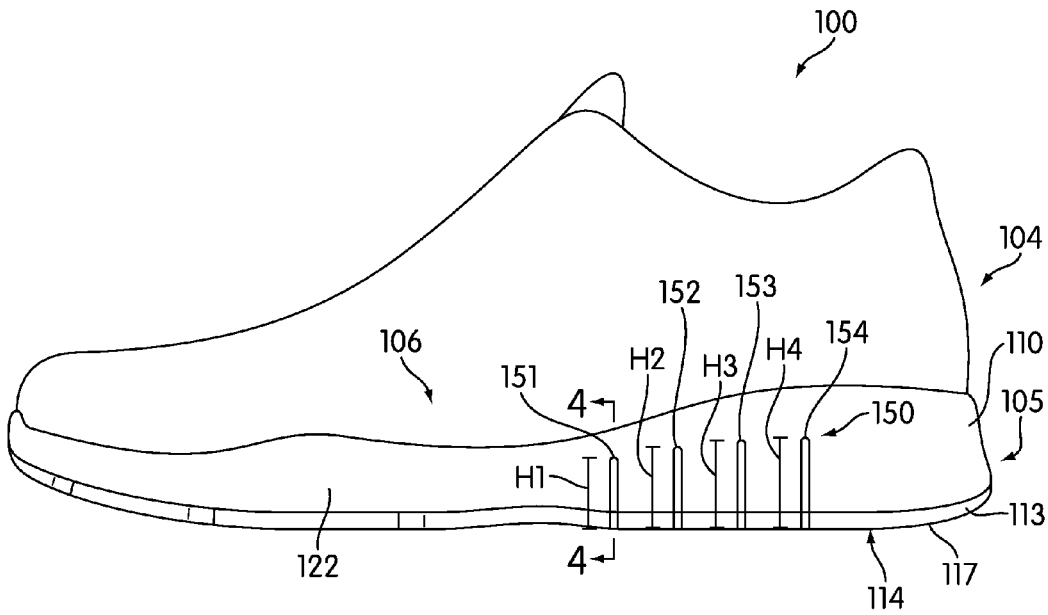
FIG. 3 is a side view of an exemplary embodiment of an article of footwear.

In different embodiments, plurality of vertical grooves 150 may be associated with various vertical heights. Referring to FIG. 3, first vertical groove 151 may be associated with first vertical height H1. In some cases, first vertical height H1 represents a distance that first vertical groove 151 extends from lower portion 114 of sole 105. In a similar manner, second vertical groove 152, third vertical groove 153 and fourth vertical groove 154 can be associated with second vertical height H2, third vertical height H3, and fourth vertical height H4, respectively.

In some embodiments, vertical grooves of plurality of vertical grooves 150 may be associated with substantially similar vertical heights. In other embodiments, vertical grooves may be associated with substantially different vertical heights. In an exemplary embodiment, each vertical groove of plurality of vertical grooves 150 may be configured with a substantially different vertical height.

In one embodiment, first vertical height H1, second vertical height H2, third vertical height H3 and fourth vertical height H4 are substantially different. In particular, first vertical height H1 may be less than second vertical height H2. Also, second vertical height H2 may be less than third vertical height H3. Similarly, third vertical height H3 may be less than fourth vertical height H4. In other words, the vertical heights of the vertical grooves of plurality of vertical grooves 150 increase in a direction towards a rearmost portion of heel portion 104. By varying the vertical heights of plurality of vertical grooves 150, the flexibility of second sidewall 122 may be fine tuned.

A plurality of vertical grooves can be formed in any manner known in the art. In an exemplary embodiment, a mold used to make a sole can include projections that are used to form one or more vertical grooves. In particular, during the molding process the molding material may fill the mold around the projections in a manner that forms grooves in one or more portions of the sole. In other embodiments, however, a plurality of vertical grooves may be formed by removing portions of a sole. For example, in an alternative embodiment, a plurality of vertical grooves can be created by cutting out material from a sidewall of a sole.

Figure 4:
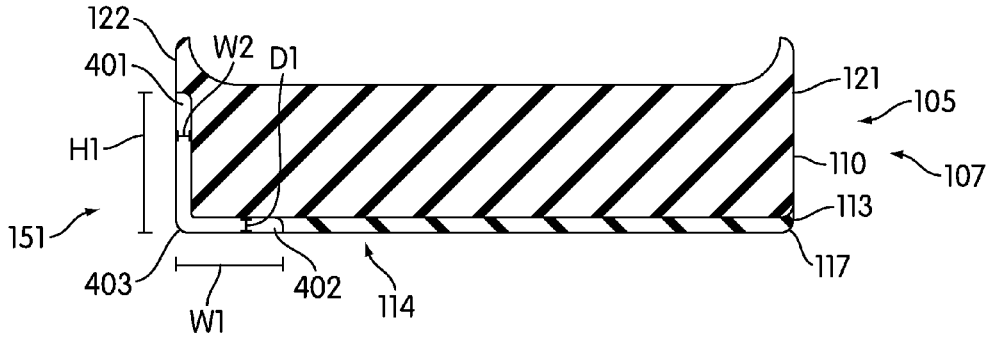
FIG. 4 is a cross sectional view of an exemplary embodiment of a sole of an article of footwear.

FIG. 4 is a cross sectional view of an exemplary embodiment of sole 105. For purposes of clarity, sole 105 is illustrated without upper 102 in FIG. 4. In some embodiments, first vertical groove 151 may extend from second sidewall 122 to lower portion 114 of outsole 113. In particular, first end portion 401 of first vertical groove 151 may be disposed on second sidewall 122 of midsole 110. Similarly, second end portion 402 of first vertical groove 151 can be disposed on lower portion 114 of outsole 113. First vertical groove 151 can also include intermediate portion 403, disposed between first end portion 401 and second end portion 402. In some cases, intermediate portion 403 may be disposed in peripheral edge 117 of sole 105.

In different embodiments, vertical grooves may be configured in various shapes. Examples of shapes, include, but are not limited to, square shapes, rectangular shapes, elliptical shapes, triangular shapes, regular shapes, irregular shapes as well as other types of shapes. In one embodiment, first vertical groove 151 can have an L-like shape.

Generally, different portions of first vertical groove 151 may be associated with various sizes. As previously discussed, first end portion 401, associated with second sidewall 122, may have first vertical height H1. In a similar manner, second end portion 402 may extend first width W1 across outsole 113. In some embodiments, first vertical height H1 may be substantially similar in length to first width W1. In other embodiments, first width W1 may be substantially longer than first vertical height H1. In an exemplary embodiment, first vertical height H1 is substantially longer than first width W1. In other words, first end portion 401 is substantially longer than second end portion 402.

In different embodiments, the depth of vertical grooves can vary. For example, first end portion 401 may extend second width W2 into second sidewall 122. Second width W2 may be associated with various values ranging from 0.01 to 1 millimeter (mm). In one embodiment, second width W2 may have a value of 0.8 mm. In other words, first end portion 401 may have a relatively shallow depth.

Similarly, second end portion 402 can extend first depth D1 into lower portion 114. In some cases, first depth D1 may be less than the thickness of outsole 113. In other cases, first depth D1 may be greater than the thickness of outsole 113. This may allow second end portion 402 to extend into midsole 110. In an exemplary embodiment, first depth D1 may be substantially similar to the thickness of outsole 113. With this arrangement, second end portion 402 may extend to midsole 110.

Figure 5:
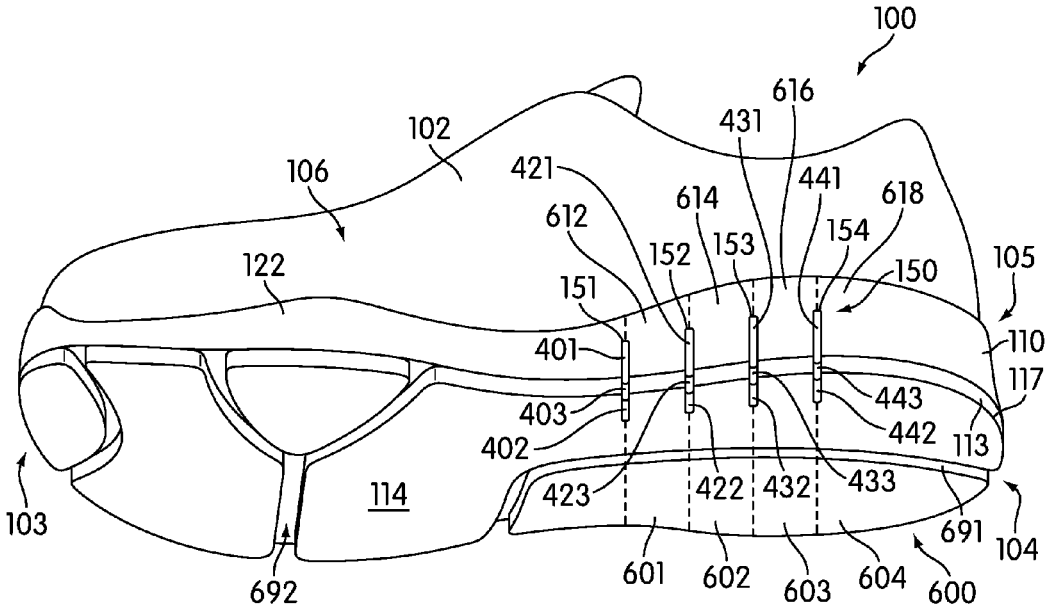
FIG. 5 is a bottom isometric view of an exemplary embodiment of an article of footwear.

In some embodiments, the remaining vertical grooves of plurality of vertical grooves 150 may be configured in a different manner than first vertical groove 151. For example, the remaining vertical grooves of plurality of vertical grooves 150 may be configured with different shapes and sizes than first vertical groove 151. In an exemplary embodiment, however, the remaining vertical grooves of plurality of vertical grooves 150 can be configured in a similar manner as first vertical groove 151. In particular, second vertical groove 152, third vertical groove 153 and fourth vertical groove 154 may have an L-like shape, as illustrated in FIG. 5.

In one embodiment, second vertical groove 152 includes first end portion 421, disposed on second sidewall 122, and second end portion 422, disposed on lower portion 114. Also, second vertical groove 152 includes intermediate portion 423 disposed between first end portion 421 and second end portion 422 in peripheral edge 117. In a similar manner, third vertical groove 153 includes first end portion 431, second end portion 432 and intermediate portion 433. Likewise, fourth vertical groove 154 comprises first end portion 441, second end portion 442 and intermediate portion 443. With this configuration, second vertical groove 152, third vertical groove 153 and fourth vertical groove 154 may comprise L-like shapes.

As previously discussed with respect to FIG. 3, the vertical heights of first end portions of vertical grooves of plurality of vertical grooves 150 are substantially different. Although each vertical height of first end portions is substantially different, the size of other portions of the vertical grooves may be substantially similar. For example, second end portions may extend a substantially similar width across sole 105. It is also possible that vertical grooves of plurality of vertical grooves 150 may be associated with different depths than first vertical groove 151. In one embodiment, however, the remaining vertical grooves of plurality of vertical grooves 150 may be configured with substantially similar depths as first vertical groove 151.

In different embodiments, plurality of vertical grooves 150 may be oriented in different directions on heel portion 104, including, but not limited to, vertical, longitudinal, lateral and directions between a longitudinal, lateral and vertical direction. For example, in some embodiments, first end portions of vertical grooves of plurality of vertical grooves 150 may extend in a direction between a vertical and longitudinal direction. In other words, first end portions can be slanted. However, in an exemplary embodiment, first end portions of vertical grooves of plurality of vertical grooves 150 may extend in a substantially vertical direction through second sidewall 122. In contrast, second end portions of plurality of vertical grooves 150 may extend in a substantially lateral direction through heel portion 104.

A sole of an article of footwear can include provisions to facilitate twisting of a heel portion. In some embodiments, a sole may facilitate twisting by allowing portions of the sole to move substantially independently of each other. In some cases, a plurality of vertical grooves can allow laterally extending portions of a sole to articulate substantially independently of each other. Using this arrangement, the plurality of vertical grooves can facilitate twisting of a heel portion.

Figure 6:
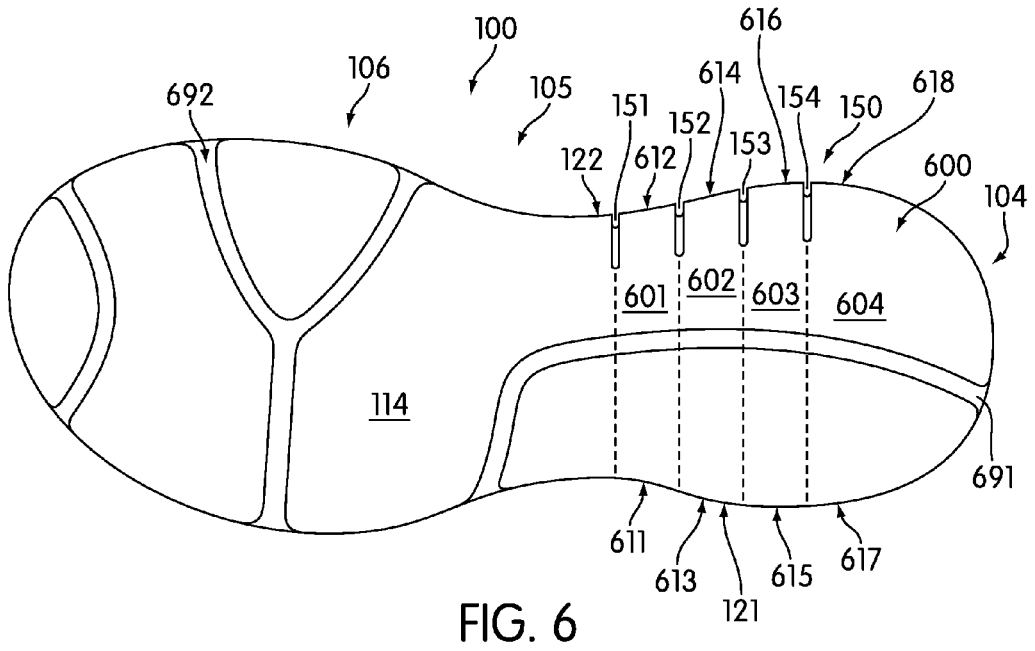
FIG. 6 is a plan view of an exemplary embodiment of a sole of an article of footwear.

Referring to FIGS. 5 and 6, heel portion 104 of sole 105 comprises laterally extending portions. Laterally extending portions can be portions of heel portion 104 that extend substantially laterally across heel portion 104. In one embodiment, heel portion 104 includes first laterally extending portion 601, second laterally extending portion 602, third laterally extending portion 603 and fourth laterally extending portion 604, collectively referred to as set of laterally extending portions 600. In other embodiments, heel portion 104 may include more or less laterally extending portions.

Set of laterally extending portions 600 may extend from first sidewall 121 to second sidewall 122 of heel portion 104. In some cases, this can provide laterally extending portions with a generally rectangular shape. For example, first laterally extending portion 601, second laterally extending portion 602 and third laterally extending portion 603 can have substantially rectangular shapes. In contrast, in one embodiment, fourth laterally extending portion 604 may have a semi-circular shape. With this configuration, fourth laterally extending portion 604 can comprise a rearmost portion of heel portion 104.

In some embodiments, end portions of laterally extending portions may be associated with first sidewall 121 and second sidewall 122. For example, first laterally extending portion 601 can include first end portion 611 associated with first sidewall 121. Also, first laterally extending portion 601 can include second end portion 612 that is associated with second sidewall 122. Similarly, second laterally extending portion 602 can include third end portion 613 associated with first sidewall 121 and fourth end portion 614 associated with second sidewall 122. In addition, third laterally extending portion 603 includes fifth end portion 615 and sixth end portion 616 associated with first sidewall 121 and second sidewall 122, respectively. Finally, fourth laterally extending portion 604 includes seventh end portion 617 and eighth end portion 618 associated with first sidewall 121 and second sidewall 122, respectively.

In one embodiment, first end portion 611 of first laterally extending portion 601 may be integrally formed with third end portion 613 of second laterally extending portion 602 on first sidewall 121. Furthermore, all end portions of laterally extending portions that are disposed on first sidewall 121 may be integrally formed with first sidewall 121. In other words, first end portion 611, third end portion 613, fifth end portion 615 and seventh end portion 617 can be integrally formed with first sidewall 121.

In contrast, end portions of laterally extending portions that are associated with second sidewall 122 may be spaced apart. For example, second end portion 612 of first laterally extending portion 601 may be substantially spaced from fourth end portion 614 of second laterally extending portion 602 on second sidewall 122. In particular, second end portion 612 may be separated from fourth end portion 614 by second vertical groove 152. In a similar manner, third vertical groove 153 may separate fourth end portion 614 and sixth end portion 616. Also, fourth vertical groove 154 can separate sixth end portion 616 and eighth end portion 618.

By separating end portions disposed on second sidewall 122, plurality of vertical grooves 150 can facilitate twisting of heel portion 104. In particular, the space provided by plurality of vertical grooves 150 allows the end portions disposed on second sidewall 122 to move substantially independently of each other. For example, second end portion 612 of first laterally extending portion 601 may move substantially independently of fourth end portion 614 of second laterally extending portion 602. Furthermore, second end portion 612, fourth end portion 614, sixth end portion 616 and eighth end portion 618 may all move substantially independently of each other because of the spacing provided by plurality of vertical grooves 150.

Although second end portion 612, fourth end portion 614, sixth end portion 616 and eighth end portion 618 can move substantially independently of each other, first end portion 611, third end portion 613, fifth end portion 615 and seventh end portion 617 are integrally formed and move together. This configuration can allow heel portion 104 to undergo torsion as end portions disposed on second sidewall 122 articulate substantially independently of each other while end portions disposed on first sidewall 121 move together. In other words, plurality of vertical grooves 150 allow heel portion 104 of sole 105 to undergo torsion by increasing the flexibility of second sidewall 122 over first sidewall 121. This will be discussed in more detail later in this detailed description.

In different embodiments, plurality of vertical grooves 150 can be configured in different manners to modify the substantially independent movement of set of laterally extending portions 600. For example, in some cases, the depth of plurality of vertical grooves 150 can be increased to allow set of laterally extending portions 600 a greater range of substantially independent movement. In other cases, plurality of vertical grooves 150 can extend a greater distance on lower portion 114 to facilitate greater twisting of heel portion 104 as set of laterally extending portions 600 move substantially independently. With this configuration, features of plurality of vertical grooves 150 can be adjusted to fine tune the torsion capabilities of sole 105.

A heel portion configured to undergo torsion may include additional provisions to increase the flexibility of a sole. In some embodiments, the sole may also include flex grooves. For example, referring to FIGS. 5 and 6, sole 105 includes heel flex groove 691. In addition, in one embodiment, sole 105 also includes forefoot flex grooves 692. However, it should be understood that heel flex groove 691 and forefoot flex grooves 692 are optional. In other embodiments, sole 105 can be associated with various flex grooves configured in different patterns.

Generally, sole 105 and upper 102 may be made from materials known in the art for making articles of footwear. For example, sole 105 may be made from any suitable material, including, but not limited to, elastomers, siloxanes, natural rubber, other synthetic rubbers, aluminum, steel, natural leather, synthetic leather, or plastics. Also, upper 102 may be made from any suitable material, including, but not limited to, nylon, natural leather, synthetic leather, natural rubber or synthetic rubber. In some cases, upper 102 can be made of any suitable knitted, woven or non-woven material.

FIGS. 7-11 illustrate isometric views of exemplary embodiments of a series of movements that may be made as a wearer of article 100 runs or walks. For purposes of clarity, the wearer of article 100 is not illustrated in FIGS. 7-11. These embodiments of movements that may be executed while walking or running are intended to be exemplary; in other embodiments, a different series of movements may occur as a wearer of article 100 runs or walks.

Figure 7:
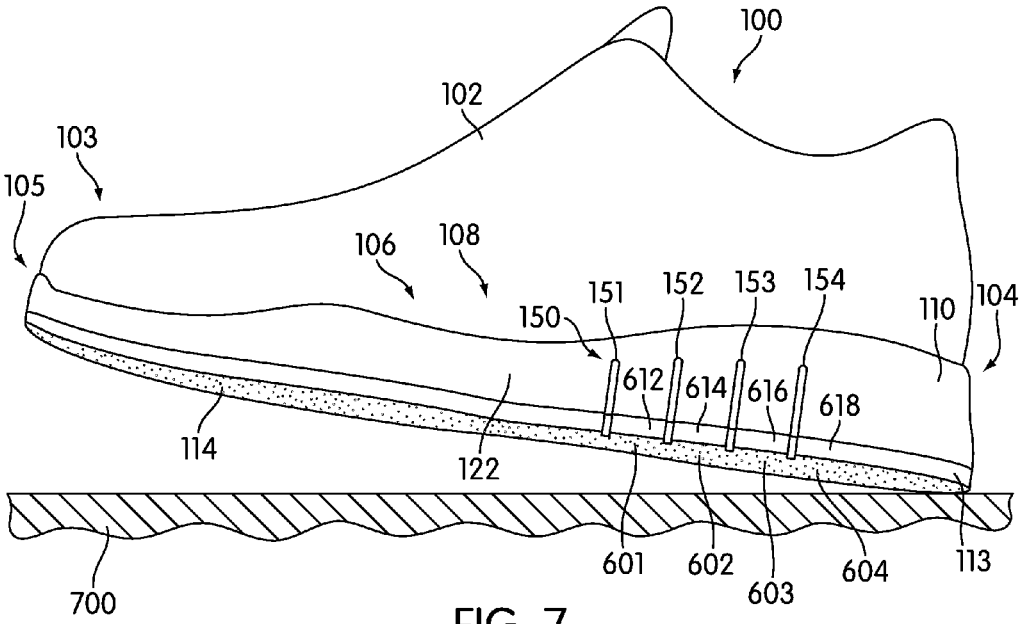
FIG. 7 is a side view of an exemplary embodiment of an article of footwear contacting a ground surface.

Referring to FIG. 7, as a wearer of article 100 steps forward while running or walking, heel portion 104 of article 100 may contact ground surface 700 first. In some cases, a lateral portion of heel portion 104, not shown for purposes of clarity, may contact ground surface 700 first. As the wearer of article 100 continues to move forward, forefoot portion 103, midfoot portion 108 and medial portion 106 of article 100 may confront ground surface 700 in a downward movement.

Without provisions to undergo torsion, a forefoot portion, midfoot portion and medial portion of an article may confront a ground surface in a downward movement at a substantially same time. This can cause a jarring impact that can disturb the lateral stability and agility of a wearer of the article. In contrast, in embodiments where vertical grooves increase the flexibility of a first sidewall with respect to a second sidewall, a sole may undergo torsion so a lower portion of the sole gradually contacts the ground surface until the entirety of the lower surface contacts the ground surface. By undergoing torsion, a sole can provide a smoother transition as a lower portion confronts a ground surface.

Figure 8:
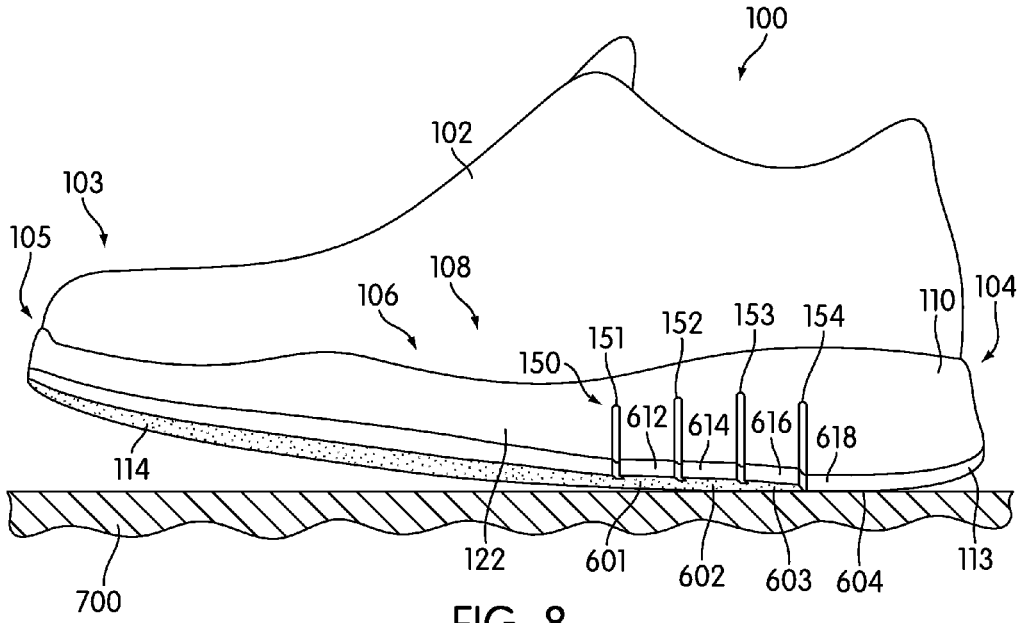
FIG. 8 is a side view of an exemplary embodiment of an article of footwear rolling downward and contacting a ground surface.

Referring to FIG. 8, fourth vertical groove 154 may flex and extend to allow eighth end portion 618 to move substantially independently of sixth end portion 616, fourth end portion 614 and second end portion 612. In particular, eighth end portion 618 can move downward and laterally to confront ground surface 700. As eighth end portion 618 moves downward and laterally, heel portion 104 can undergo torsion. The torsion of heel portion 104 enables fourth laterally extending portion 604 to confront ground surface 700 while the remaining laterally extending portions are disposed above ground surface 700. With this configuration, heel portion 104 may confront ground surface 700 in a gradual manner that can minimize a force of an impact.

Figure 9:
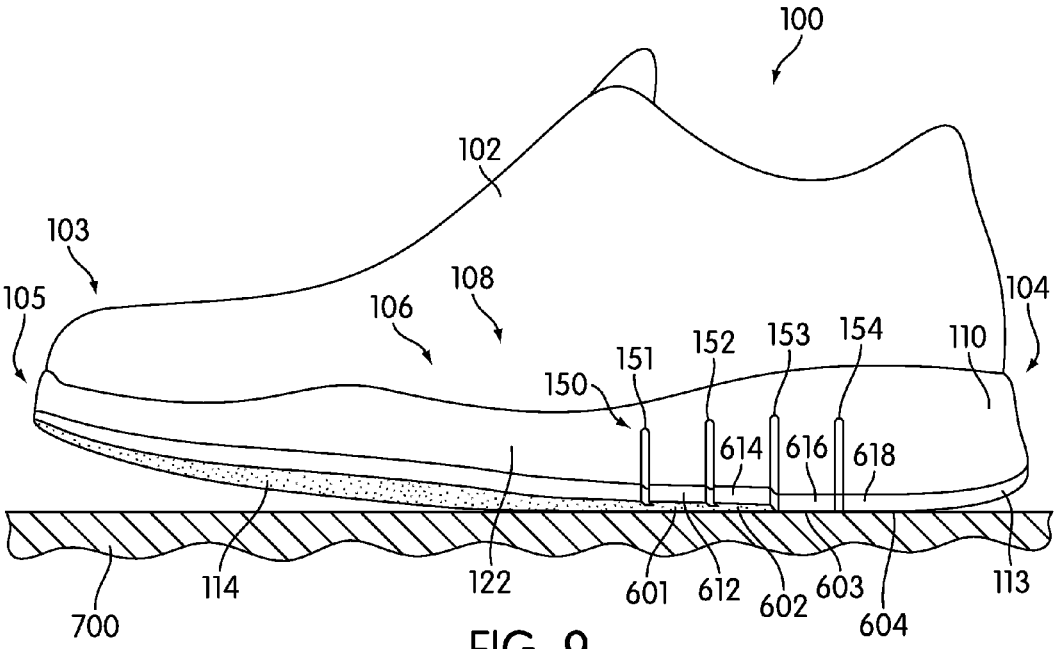
FIG. 9 is a side view of an exemplary embodiment of an article of footwear rolling downward and contacting a ground surface.

With continued movement toward forefoot portion 103 and medial portion 106, additional vertical grooves of plurality of vertical grooves 150 can flex to facilitate substantially independent movement of laterally extending portions. Referring to FIG. 9, third vertical groove 153 can flex to facilitate substantially independent movement of sixth end portion 616 with respect to fourth end portion 614. This substantially independent movement allows heel portion 104 to twist so that third laterally extending portion 603 confronts ground surface 700 while second laterally extending portion 602 is disposed above ground surface 700.

Figure 10:
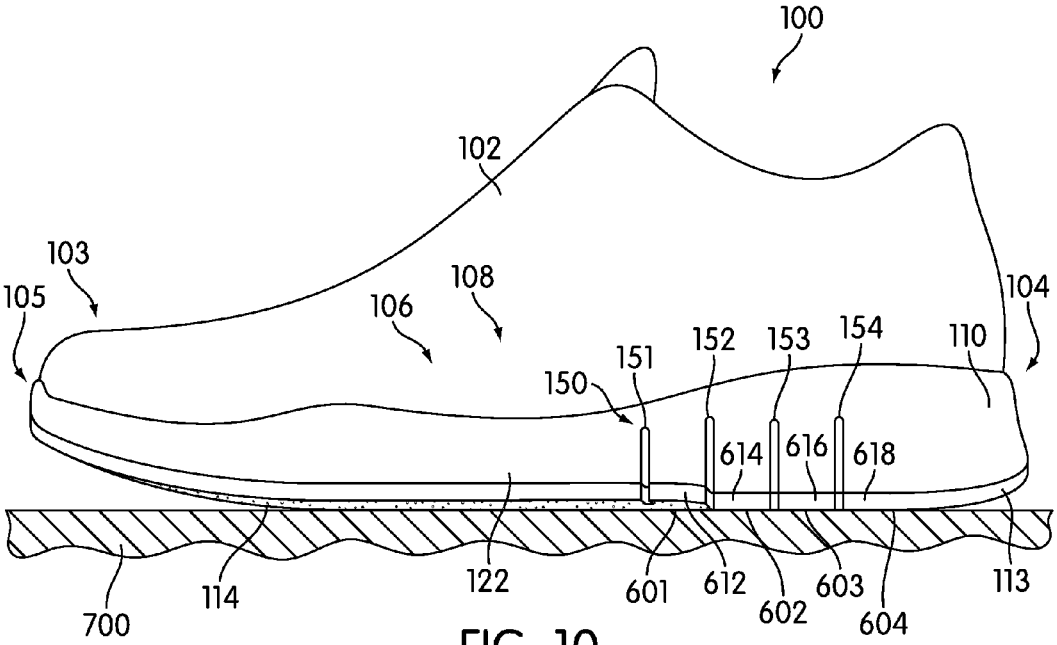
FIG. 10 is a side view of an exemplary embodiment of an article of footwear rolling downward and contacting a ground surface.

After third laterally extending portion 603 confronts ground surface 700, second vertical groove 152 may flex to enable substantially independent movement of second end portion 612 with respect to fourth end portion 614. Referring to FIG. 10, second laterally extending portion 602 confronts ground surface 700 while first laterally extending portion 601 is disposed above ground surface 700. With plurality of vertical grooves 150 configured to facilitate twisting of heel portion 104, laterally extending portions can move substantially independently of each other to progressively contact ground surface as a wearer of article 100 walks or runs.

Figure 11:
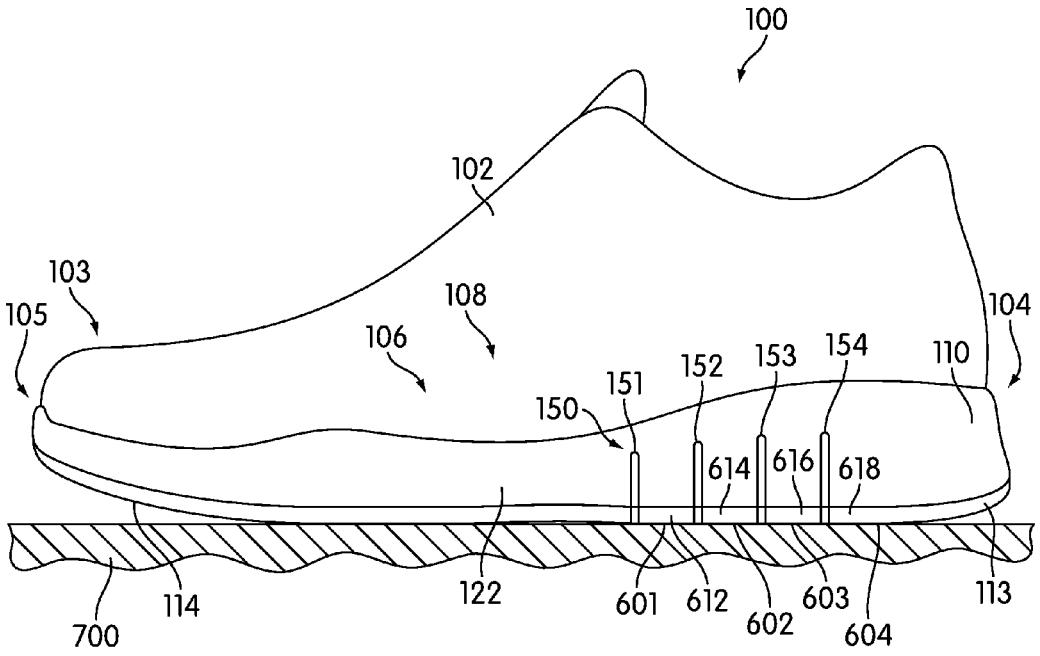
FIG. 11 is a side view of an exemplary embodiment of a substantial entirety of a lower portion of a sole of an article of footwear contacting a ground surface.

As heel portion 104 rolls toward ground surface 700, laterally extending portions of heel portion 104 progressively contact ground surface 700 until a substantial entirety of lower portion 114 is planted on ground surface 700. Referring to FIG. 11, a substantial entirety of lower portion 114 is planted on ground surface 700. In embodiments that include plurality of vertical grooves 150, the jarring force of an entirety of lower portion 114 confronting ground surface 700 in a downward movement at a substantially same time can be prevented. This configuration enhances the lateral stability and agility of a wearer of article 100.

Figure 12:
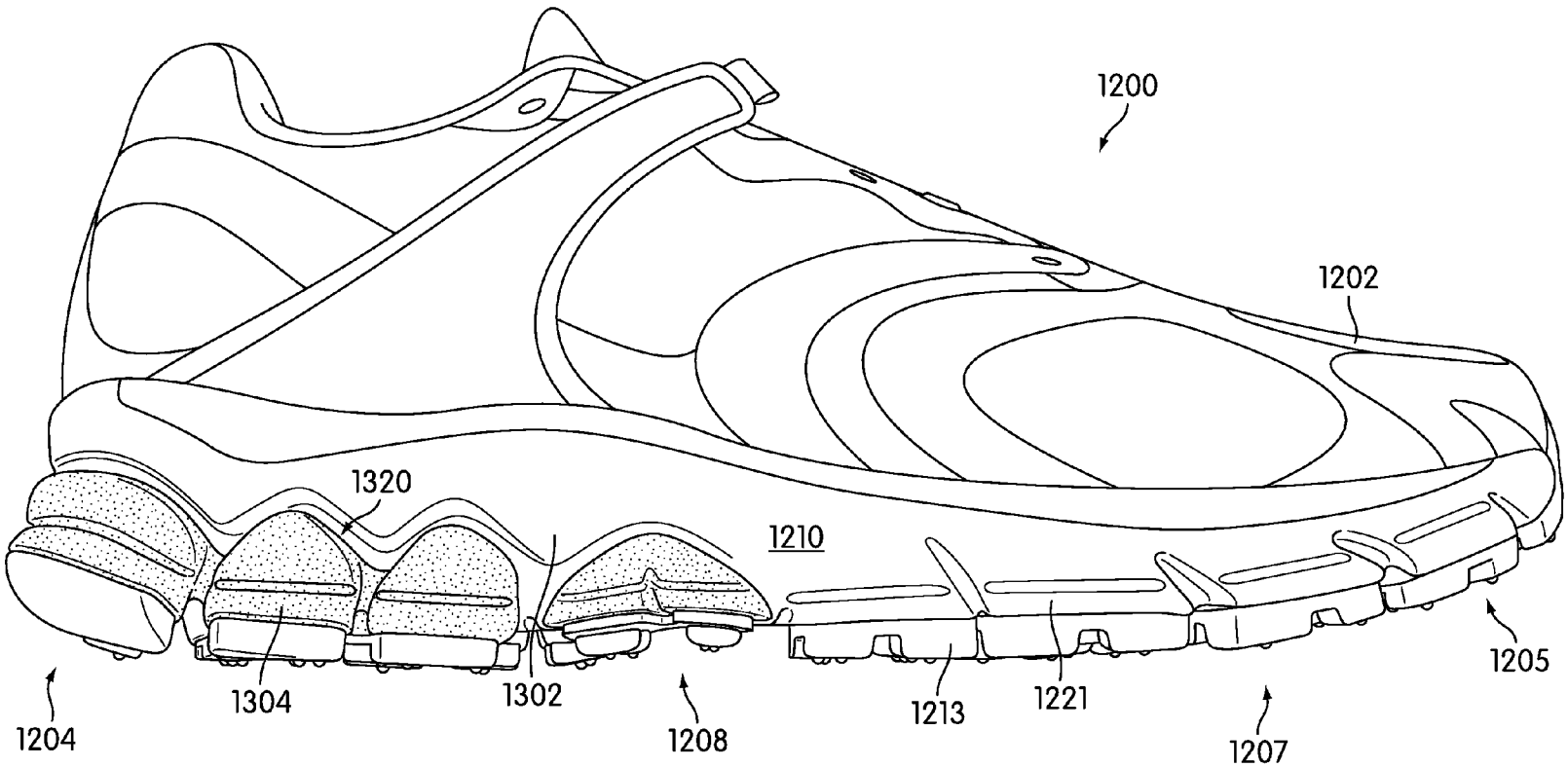
FIG. 12 is a side view of an embodiment of an article of footwear.
Figure 13:
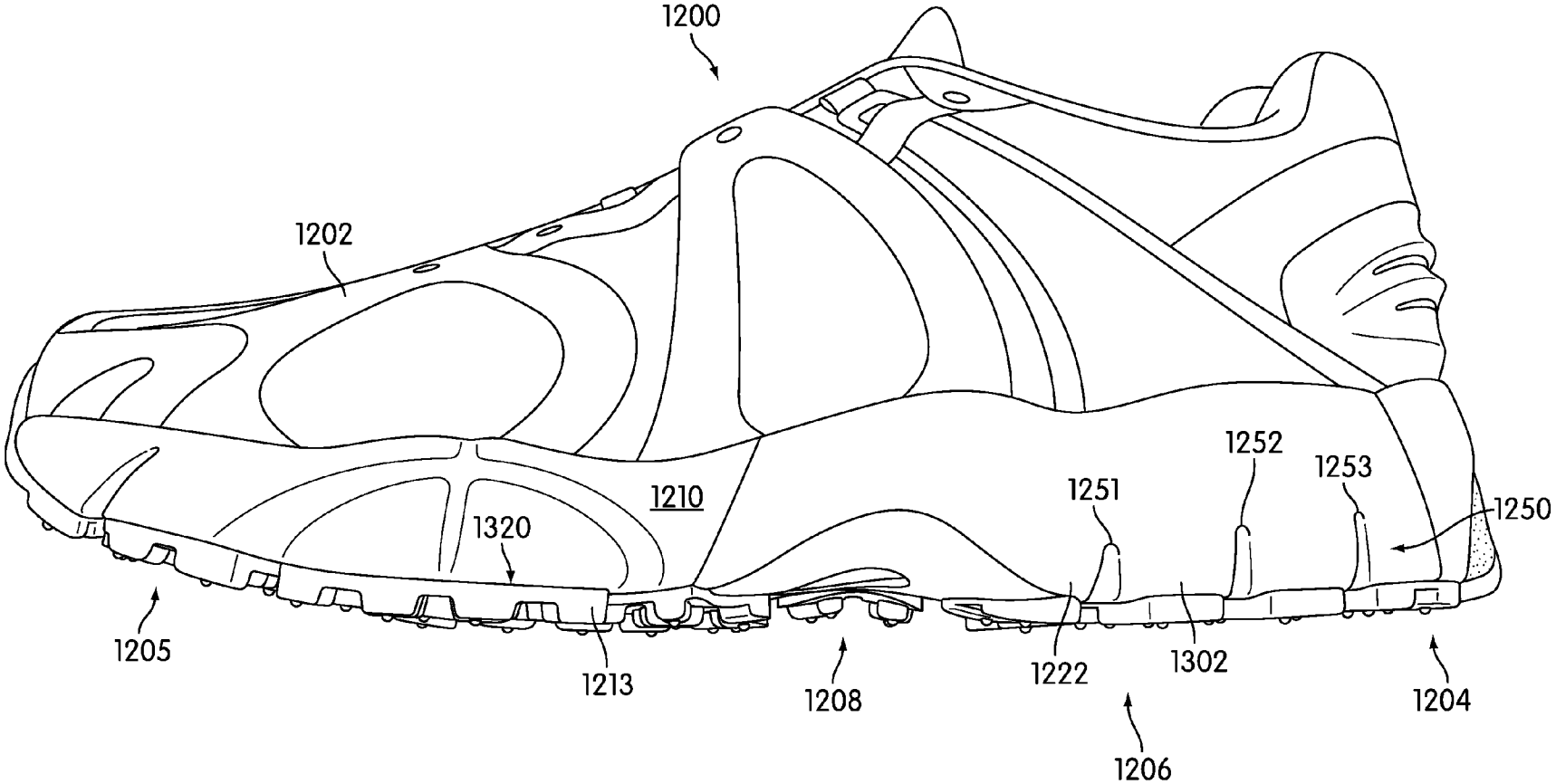
FIG. 13 is a side view of an embodiment of an article of footwear.
Figure 14:
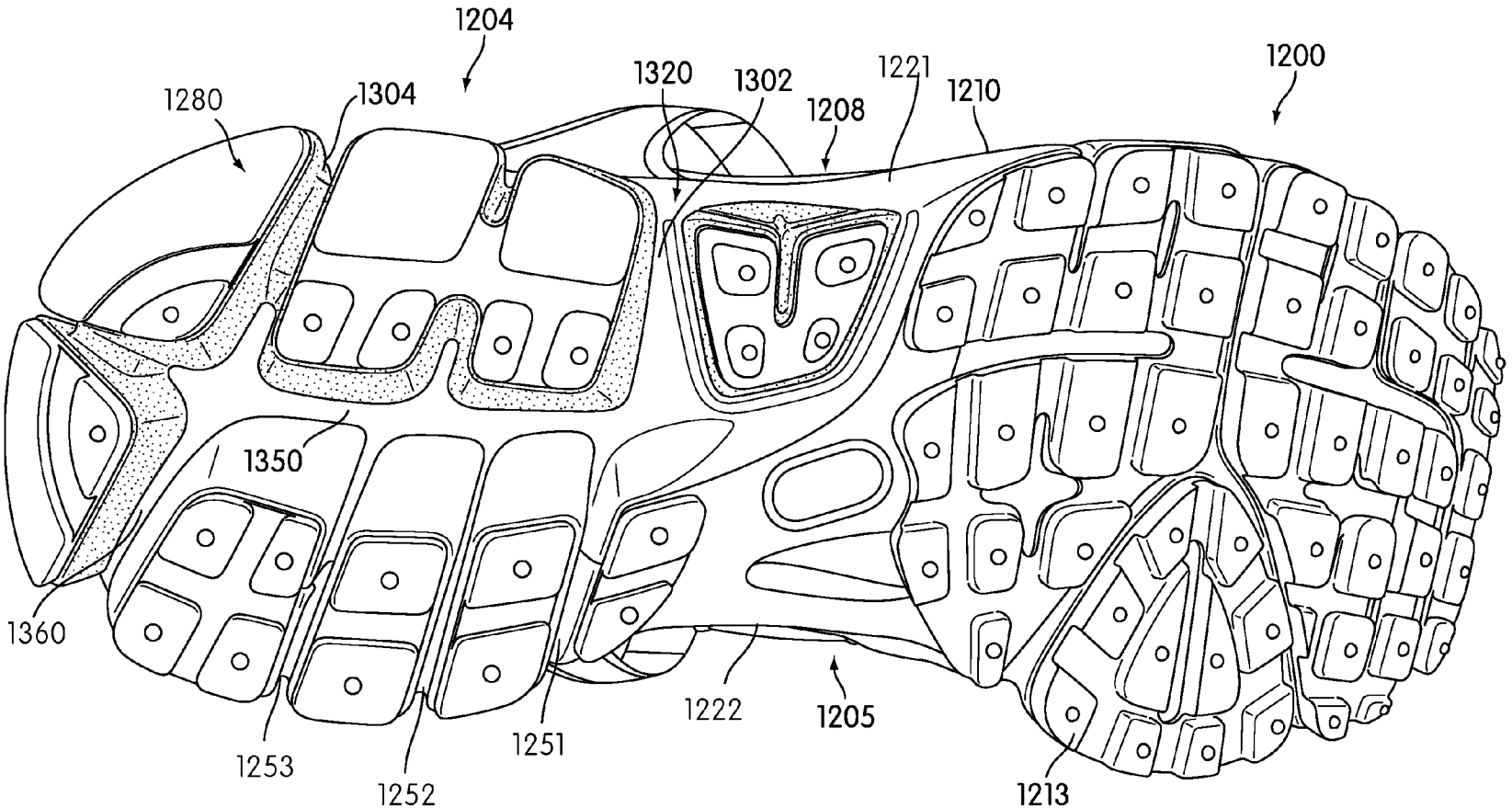
FIG. 14 is a bottom view of an embodiment of a sole of an article of footwear.

FIGS. 12 through 14 illustrate another embodiment of article of footwear 1200. In particular, FIGS. 12 and 13 are lateral and medial side views, respectively, of an exemplary embodiment of article of footwear 1200, while FIG. 14 is a bottom view of article of footwear 1200.

In a similar manner to the previous embodiment, article 1200 can be provided with upper 1202 and sole 1205. Upper 1202 is configured to receive a foot of a wearer of article 1200. Generally, upper 1202 may be any type of upper. In particular, upper 1202 could have any design, shape, size and/or color. For example, in embodiments where article 1200 is a basketball shoe, upper 1202 could be a high top upper that is shaped to provide high support on an ankle. In embodiments where article 1200 is a running shoe, upper 1202 could be a low top upper.

In some embodiments, sole 1205 can comprise midsole 1210 and outsole 1213. In some embodiments, outsole 1213 can be configured to contact a ground surface. Examples of ground surfaces include, but are not limited to: indoor ground surfaces such as wood and concrete floors, pavement, natural turf, synthetic turf, dirt, as well as other surfaces. In some cases, outsole 1213 may include provisions for traction, including, but not limited to, traction elements, studs and/or cleats. It will be understood that in other embodiments, an outsole may be optional. In other embodiments, for example, a midsole may be configured to contact a ground surface directly. Furthermore, in other embodiments, a midsole could be provided with various traction elements, studs and/or cleats.

In some embodiments, midsole 1210 may comprise one or more sidewalls. The term "sidewall" as used throughout this detailed description and in the claims refers to an outer portion of a midsole that extends from an outsole to an upper. In some cases, midsole 1210 can include first sidewall 1221 and second sidewall 1222, disposed opposite of first sidewall 1221. In one embodiment, first sidewall 1221 may be associated with lateral portion 1207 of sole 1205, as illustrated in FIG. 12. Similarly, second sidewall 1222 can be associated with medial portion 1206 of sole 1205, as illustrated in FIG. 13.

In some embodiments, midsole 1210 can include one or more portions. In some cases, midsole 1210 may comprise first portion 1302 and second portion 1304. For purposes of clarity, second portion 1304 is shaded in the current embodiment. In particular, first portion 1302 may extend throughout the length and width of sole 1205. In contrast, second portion 1304 may only extend through some portions of sole 1205. In one embodiment, for example, second portion 1304 may be associated with lateral portion 1207 of midfoot portion 1208 and heel portion 1204.

In some embodiments, first portion 1302 and second portion 1304 may be layered portions. In particular, second portion 1304 may be disposed on lower surface 1320 of first portion 1302. In other words, second portion 1304 may be disposed further from upper 1202 than first portion 1302. In some cases, second portion 1304 may be a ground contacting portion that is configured to provide traction for article 1200. In other embodiments, however, second portion 1304 may be covered by portions of outsole 1210.

In different embodiments, first portion 1302 and second portion 1304 can be associated with different structural properties. In some embodiments, the rigidities of first portion 1302 and second portion 1304 can vary. In one embodiment, first portion 1302 may be associated with a first rigidity and second portion 1304 may be associated with a second rigidity. In some cases, the first rigidity may be greater than the second rigidity. In other cases, the first rigidity may be less than the second rigidity. In still other cases, the first rigidity may be substantially similar to the second rigidity. In an exemplary embodiment, the first rigidity may be substantially greater than the second rigidity. For example, in an embodiment where first portion 1302 and second portion 1304 are both foam layers, first portion 1302 may be made of a harder foam than second portion 1304. With this arrangement, second portion 1304 may be configured to deform upon impact with a ground surface to enhance cushioning for article 1200.

Sole 1205 includes plurality of vertical grooves 1250. Plurality of vertical grooves 1250 may be disposed on heel portion 1204 of sole 1205. Furthermore, plurality of vertical grooves 1250 may be disposed on second sidewall 1222 of heel portion 1204. With this configuration, plurality of vertical grooves 1250 can increase the flexibility of second sidewall 1222 with respect to first sidewall 1221, which can help increase torsion in heel portion 1204.

As previously discussed, in different embodiments, the number of vertical grooves associated with a sole can vary. In another embodiment, for example, an article of footwear can include a sole configured with three vertical grooves on a medial side of the sole. By varying the number of vertical grooves on the sole, the torsion properties of the sole can be varied.

In the current embodiment, plurality of vertical grooves 1250 can include three vertical grooves. In particular, plurality of vertical grooves 1250 comprises first vertical groove 1251, second vertical groove 1252 and third vertical groove 1253. In other embodiments, plurality of vertical grooves 1250 may include more than three vertical grooves. In still other embodiments, plurality of vertical grooves 1250 may include less than three vertical grooves.

In a similar manner to the vertical grooves of the previous embodiment, plurality of vertical grooves 1250 may be relatively narrow. In particular, vertical grooves of plurality of vertical grooves 1250 may have a long narrow shape on second sidewall 1222. In other words, the vertical height of plurality of vertical grooves 1250 may substantially exceed the distances the vertical grooves extend in a longitudinal direction on second sidewall 1222.

In different embodiments, plurality of vertical grooves 1250 may be associated with various vertical heights. In some embodiments, vertical grooves of plurality of vertical grooves 1250 may be associated with substantially similar vertical heights. In other embodiments, vertical grooves may be associated with substantially different vertical heights. In an exemplary embodiment, each vertical groove of plurality of vertical grooves 1250 may be configured with a substantially similar vertical height.

In different embodiments, plurality of vertical grooves 1250 can extend through various portions of sole 1205. In some cases, plurality of vertical grooves 1250 may extend through midsole 1210. In other cases, plurality of vertical grooves 1250 may extend through outsole 1213. In an exemplary embodiment, plurality of vertical grooves 1250 may extend through both midsole 1210 and outsole 1213.

Additionally, in different embodiments, plurality of vertical grooves 1250 may extend through various portions of midsole 1210. In some cases, plurality of vertical grooves 1250 may extend through first portion 1302. In other cases, plurality of vertical grooves 1250 may extend through second portion 1304. In still other cases, plurality of vertical grooves 1250 may extend through both first portion 1302 and second portion 1304. In an exemplary embodiment, plurality of vertical grooves 1250 may extend through first portion 1302 of midsole 1210. This arrangement can help provide increased torsion in second portion 1304, which may be more rigid than first portion 1302 in some embodiments.

Referring now to FIG. 14, the geometry of heel portion 1204 can vary in different embodiments. In the current embodiment, bottom surface 1280 of heel portion 1204 is provided with central groove 1350. In this case, central groove 1350 is bounded by first portion 1302 of midsole 1210 on medial portion 1206 and by second portion 1304 of midsole 1210 on lateral portion 1207. In addition, in some embodiments, central groove 1350 can be configured to intersect rearward groove 1360 that extends in a generally lateral direction across heel portion 1204.

Generally, the shape of central groove 1350 can vary. In some cases, central groove 1350 can extend throughout substantially the entire length of heel portion 1204. In other cases, central groove 1350 can have any other length. In addition, in some embodiments, the width of central groove 1350 can vary in a substantially vertical direction. For example, in the current embodiment, the width of central groove 1350 can increase between lower surface 1320 and outsole 1213. By varying the shape of central groove 1350, the flexibility of heel portion 1204 can be fine tuned.

In different embodiments, the lateral depths of one or more vertical grooves can vary. In some embodiments, the depths of plurality of vertical grooves 1250 can be configured so that each groove of plurality of vertical grooves 1250 intersects central groove 1350. In the current embodiment, for example, plurality of vertical grooves 1250 may extend from second sidewall 1222 to central groove 1350. In particular, first vertical groove 1251, second vertical groove 1252 and third vertical groove 1253 extend from second sidewall 1222 to central groove 1350. In other embodiments, however, the depths of one or more vertical grooves can be varied so that the one or more vertical grooves do not intersect central groove 1350. By modifying the depths of plurality of vertical grooves 1250, the flexibility of second sidewall 1222 can be varied in order to fine tune the torsional properties of sole 1205.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

a sole including a midsole;

a heel portion of the sole comprising a first sidewall of the midsole and a second sidewall of the midsole;

the heel portion further comprising a first laterally extending portion and a second laterally extending portion disposed on the heel portion of the sole;

the first laterally extending portion including a first end portion associated with the first sidewall and the first laterally extending portion including a second end portion associated with the second sidewall, the first end portion and the second end portion being similar in size;

the second laterally extending portion including a third end portion associated with the first sidewall and a fourth end portion associated with the second sidewall, the third end portion and the fourth end portion being similar in size;

the first end portion being integrally formed with the third end portion on the first sidewall so that the first end portion and the third end portion move together as one; and wherein the second end portion is substantially spaced from the fourth end portion and wherein the second end portion is configured to move substantially independently of the fourth end portion.

2. The article of footwear according to claim 1, wherein the second end portion is separated from the fourth end portion by a vertical groove; and the first end portion is integrally formed with the third end portion such that the first sidewall is continuous where the first end portion is adjacent to the third end portion.

3. The article of footwear according to claim 1, wherein the first sidewall is disposed on a medial portion of the sole.

4. The article of footwear according to claim 1, wherein the first sidewall is disposed on a lateral portion of the sole.

5. The article of footwear according to claim 2, wherein the vertical groove includes a first end portion disposed on the second sidewall and wherein the vertical groove includes a second end portion disposed on an outsole of the sole.

6. The article of footwear according to claim 5, wherein the vertical groove includes an intermediate portion disposed between the first end portion and the second end portion and wherein the intermediate portion is disposed in a peripheral edge of the sole, the peripheral edge being disposed between a lower portion of the sole and the second sidewall.

7. The article of footwear according to claim 1, wherein:

the second sidewall includes a plurality of vertical grooves;

the first sidewall being asymmetric with respect to the plurality of vertical grooves in the second sidewall; and wherein the plurality of vertical grooves increases the flexibility of the second sidewall over the first sidewall.

8. The article of footwear according to claim 7, wherein the second sidewall is disposed on a medial portion of the sole.

9. The article of footwear according to claim 7, wherein the plurality of vertical grooves increases the longitudinal flexibility of the second sidewall with respect to the first sidewall.

10. The article of footwear according to claim 9, wherein each vertical height of each of the plurality of vertical grooves is substantially different.

11. The article of footwear according to claim 10, wherein the vertical heights of the vertical grooves increase in a direction towards a rearmost portion of the heel portion.

12. The article of footwear according to claim 7, wherein at least one vertical groove of the plurality of vertical grooves includes a first end portion disposed on the second sidewall and wherein the vertical groove includes a second end portion disposed on the outsole and wherein the first end portion is substantially longer than the second end portion.

13. The article of footwear according to claim 7, wherein the plurality of vertical grooves are configured to facilitate twisting of the heel portion; and wherein the plurality of vertical grooves and a continuous area of the first sidewall are located on corresponding sides of the midsole.

14. The article of footwear according to claim 1, wherein:

the second sidewall includes a plurality of vertical grooves on a heel portion of the midsole;

the first sidewall including fewer vertical grooves than the second sidewall; and wherein the plurality of vertical grooves allow the heel portion of the sole to undergo torsion.

15. The article of footwear according to claim 14, wherein the plurality of vertical grooves increases the longitudinal flexibility of the second sidewall with respect to the first sidewall.

16. The article of footwear according to claim 14, wherein the plurality of vertical grooves extend from the second sidewall to a lower portion of the outsole.

17. The article of footwear according to claim 14, wherein the plurality of vertical grooves includes a first vertical groove.

18. The article of footwear according to claim 17, wherein the first vertical groove is disposed between the first laterally extending portion of the sole and the second laterally extending portion of the sole.

19. The article of footwear according to claim 14, wherein the plurality of vertical grooves comprises three vertical grooves.

20. The article of footwear according to claim 19, wherein the plurality of vertical grooves are disposed on a medial portion of the heel portion.

21. The article of footwear according to claim 1, wherein the first end portion is integrally formed with the third end portion on the first sidewall throughout a vertical height of the first sidewall.

22. The article of footwear according to claim 1, wherein the first end portion is integrally formed with the third end portion on the first sidewall along a vertical border between the first end portion and the third end portion.

* * * * *